US008856982B1

(12) United States Patent
Kalivas

(10) Patent No.: US 8,856,982 B1
(45) Date of Patent: Oct. 14, 2014

(54) MOTION BED

(76) Inventor: Christopher George Kalivas, Patchogue, NY (US)

( * ) Notice: Subject to any disclaimer, the term of this patent is extended or adjusted under 35 U.S.C. 154(b) by 226 days.

(21) Appl. No.: 13/181,406

(22) Filed: Jul. 12, 2011

Related U.S. Application Data

(60) Provisional application No. 61/363,921, filed on Jul. 13, 2010.

(51) Int. Cl.
*A47D 9/02* (2006.01)
*A47D 9/00* (2006.01)

(52) U.S. Cl.
USPC ..... 5/109; 5/103; 5/106; 5/108; 5/11

(58) Field of Classification Search
USPC ..... 5/11, 509.1, 510, 488, 200.1, 611, 612, 5/634, 640, 103, 106, 108, 109
See application file for complete search history.

(56) References Cited

U.S. PATENT DOCUMENTS

| | | | | | |
|---|---|---|---|---|---|
| 430,616 | A * | 6/1890 | Brewer | 5/103 |
| 1,132,432 | A * | 3/1915 | Brzozowski | 5/108 |
| 1,957,005 | A * | 5/1934 | Thum | 5/124 |
| 1,973,753 | A * | 9/1934 | Friesner | 5/124 |
| 2,076,675 | A * | 4/1937 | Sharp | 5/609 |
| 2,544,298 | A * | 3/1951 | Chodacki et al. | 5/109 |
| 3,031,687 | A * | 5/1962 | Stevens et al. | 5/109 |
| 3,125,767 | A * | 3/1964 | Griggs et al. | 5/109 |
| 3,439,363 | A * | 4/1969 | Meeks | 5/109 |
| 3,656,195 | A * | 4/1972 | Leahey | 5/99.1 |
| 3,668,721 | A * | 6/1972 | Jenkins | 5/109 |
| 4,108,415 | A * | 8/1978 | Hauray et al. | 248/370 |
| 4,114,209 | A * | 9/1978 | Sandlin | 5/658 |
| 4,615,059 | A * | 10/1986 | Darowski | 5/108 |
| 4,685,159 | A * | 8/1987 | Oetiker | 5/608 |
| 4,752,980 | A * | 6/1988 | Nafte | 5/109 |
| 4,881,285 | A * | 11/1989 | Zeeb | 5/103 |
| 4,947,832 | A * | 8/1990 | Blitzer | 601/56 |
| 4,970,740 | A * | 11/1990 | Crawford | 5/109 |
| 5,007,410 | A * | 4/1991 | DeLaney | 601/53 |
| 5,021,982 | A * | 6/1991 | Crosbie et al. | 703/8 |
| 5,088,138 | A * | 2/1992 | Munster | 5/109 |
| 5,183,457 | A * | 2/1993 | Gatts et al. | 600/21 |
| 5,228,155 | A * | 7/1993 | Shultz et al. | 5/109 |
| 5,437,608 | A * | 8/1995 | Cutler | 601/49 |
| 5,802,634 | A * | 9/1998 | Onishi et al. | 5/93.2 |
| 5,947,557 | A * | 9/1999 | Bellefleur | 297/281 |
| 6,490,880 | B1 * | 12/2002 | Walsh | 62/457.9 |
| 6,854,138 | B2 * | 2/2005 | Xu | 5/106 |
| 6,941,594 | B1 * | 9/2005 | Mosley | 5/11 |
| 7,033,176 | B2 * | 4/2006 | Feldman et al. | 434/55 |
| 7,478,446 | B2 * | 1/2009 | Sims, Jr. | 5/607 |
| 7,607,734 | B2 * | 10/2009 | Clapper et al. | 297/273 |
| 7,698,761 | B2 * | 4/2010 | Neuenswander et al. | 5/618 |
| 2007/0074342 | A1 * | 4/2007 | Kaempfen | 5/11 |
| 2010/0223722 | A1 * | 9/2010 | Burnett | 5/11 |

* cited by examiner

*Primary Examiner* — Robert G Santos
*Assistant Examiner* — Ifeolu Adeboyejo
(74) *Attorney, Agent, or Firm* — Collard & Roe, P.C.; Christopher B. Garvey

(57) ABSTRACT

A bed assembly (1) has a stationary frame (2), which sits on a floor and supports the entire bed assembly. A central frame (4) moves in a first horizontal direction relative to the stationary frame, and is moveably supported by the stationary frame. An outer frame (8) moves in a second horizontal direction relative to the second frame, and is moveably supported by the second frame.

13 Claims, 11 Drawing Sheets

113
212
Frame
213
114
6
6a
402
404
6d
113
114
111
6b
112
2"
101
111
112

6e
1/2" Nut 108
6a
101
6
6e
Bolt Head 106
6d
212
111
112
Frame 213
102
1/4"
111
402
6d
112
404

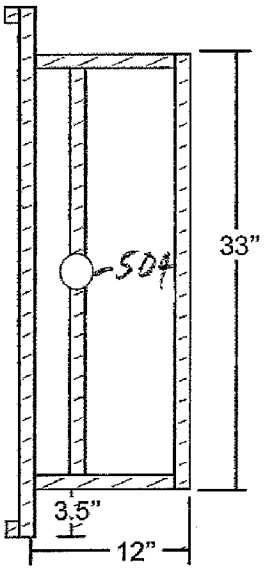
Fig. 8C
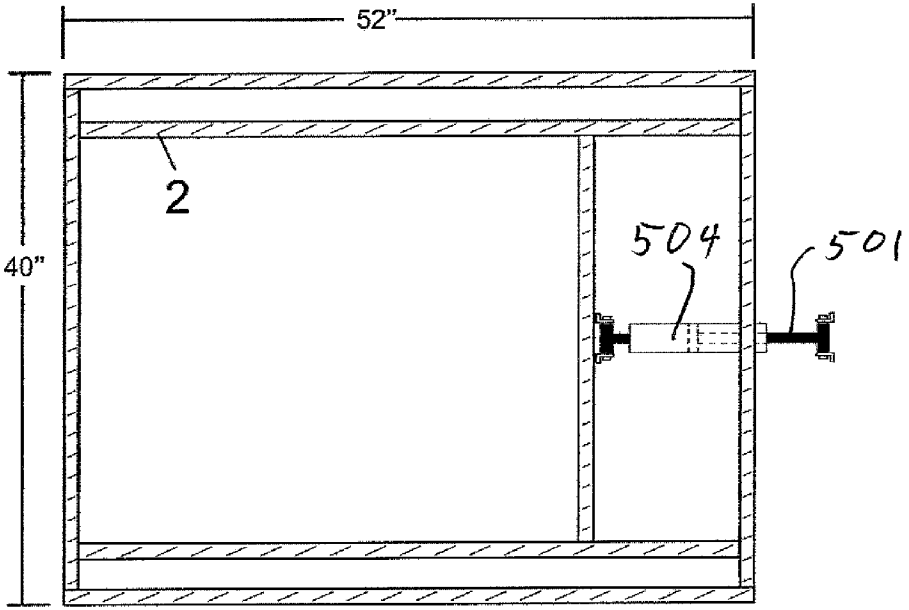
Figure 8 A
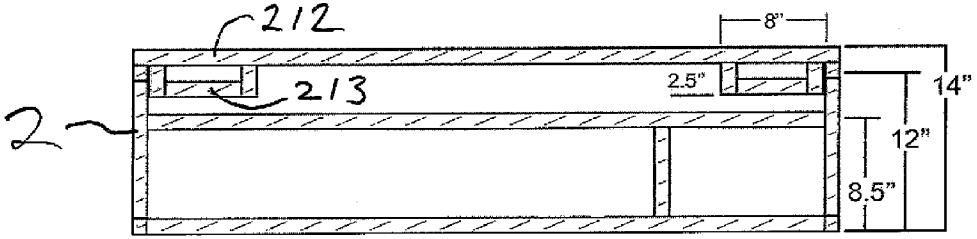
Stationary Frame Fig 8 B 4
514
511
40"
66"
504
501
514
511
4

Center Frame 4
13.5"
6"
7.5"
3.5"
59"
402
404

MOTION BED

This is a non-provisional patent application taking priority from Provisional Application 61/363,921, filed 13 Jul. 2010.

This invention is a bed comprising three independent frames, connected together, creating a side-to-side motion similar to a hammock or cradle, with also the ability to move head to toe like a swing or rocking chair. It does not go up and down except for a small rise as it peaks at the maximum swing and it is at its lowest point in the middle of the swing. There is one motor for controlling both horizontal directions and it is variable speed. A stoke of zero to six inches for each direction is controlled independently using a hand control. Hydraulic or electrical linear actuators may also be used.

As a sleeping aid it is like when mom rocked the cradle. Preliminary tests indicate that it may result in a more restful sleep and less need for sleep.

Although the hospital industry has many types of beds for therapeutic uses that vibrate and oscillate, most of the equipment developed is designed for the purposes of handling the patient. The inventor's readings give him reason to believe that, if tested, the present invention might stimulate a comma patient. The gentle motion may help bed-ridden patients with bed sores, or may help avoid blood clotting. The inventor is unaware of any similar automatic bed. Other vibrational beds have had therapeutic effects. But I have not found a bed with similar motion to the present invention to test these thoughts.

BRIEF DESCRIPTION OF THE DRAWINGS

FIG. 8A is a top plan view of stationary frame 2.

FIG. 8B is a side elevation thereof.

FIG. 8C is a foot-ward projection from FIG. 8A.

FIG. 9B is a side elevation thereof.

FIG. 9C is a foot-ward projection from FIG. 9A.

DETAILED DESCRIPTION OF THE DRAWINGS

Figure 1:
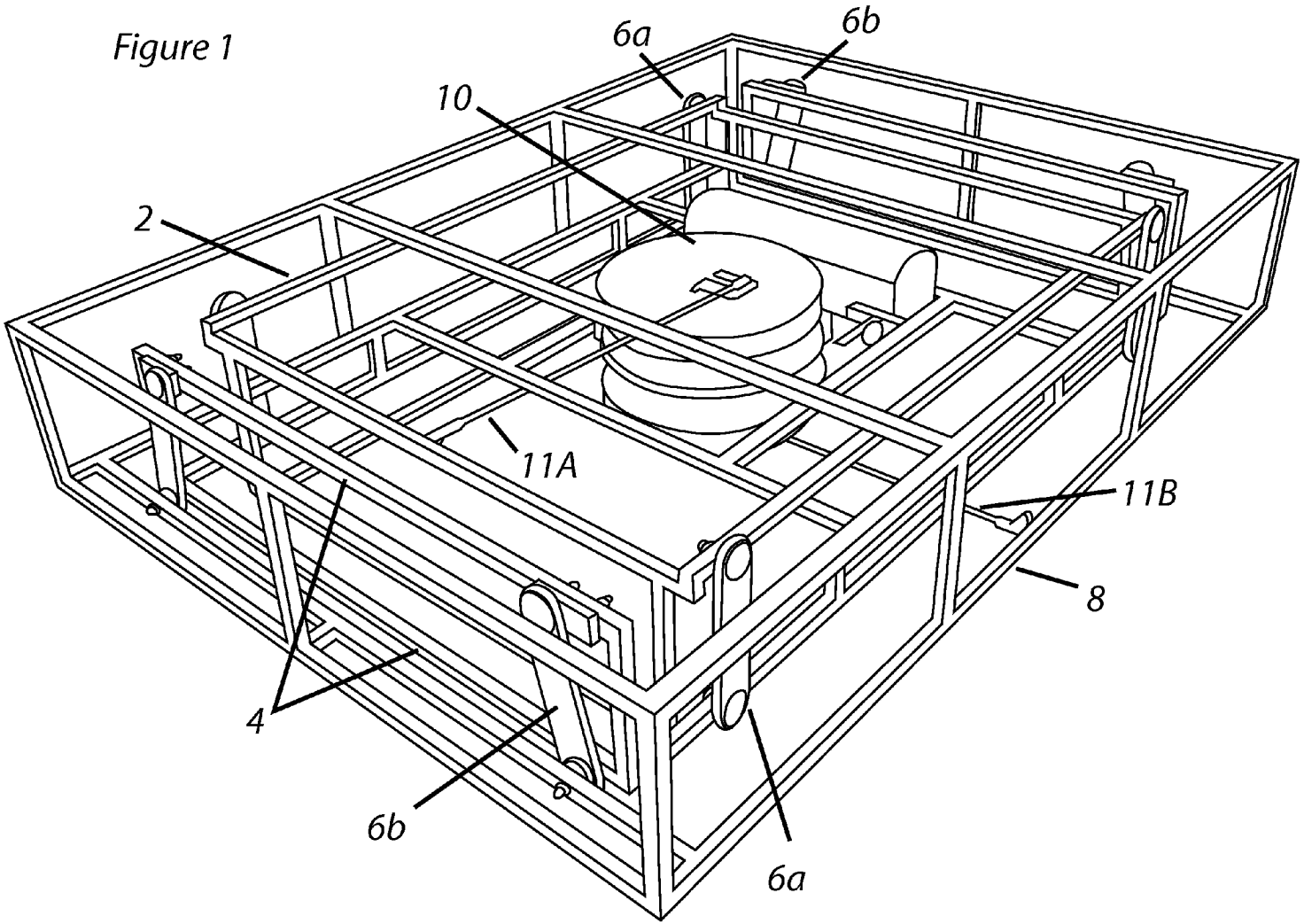
FIG. 1 is an oblique perspective view of the complete bed frame assembly, assembled without the box spring and mattress on top.

As in FIG. 1, the bed assembly 1 comprises: a stationary frame (2), which sits on the floor and supports the entire bed assembly FIG. 1. Stationary frame (2) is the innermost of the three frames 2, 4, & 8.

The second or Center frame (4) hangs from the stationary frame (2) using four swing arms (6*a*) with bearings. The second or Center frame (4) hangs outside the stationary frame (2), centered between stationary frame (2) and the third or outer frame (8).

The third or outer frame (8), which supports the box spring and mattress (not shown), hangs from the center frame (4) also using four swing arms (6*b*) with bearings.

As in FIG. 7, Each swing arm 6*a*, 6*b* comprises an arm 6*c*, and a pair of low friction bearings 6*d*. In this case the bearing 6*d* is a four-bolt flange bearing assembly around a bolt 6*e*. Other types of bearings are also serviceable.

In FIG. 1 the center frame (4) supports the power transmission (10). Positioning the power transmission (10) onto the center frame (4) and having it swing with the bed allows equal mechanical advantage to control the motion of pulling and pushing using rod 11A from the stationary frame (2) and rod 11B to the outer frame (8) as in FIG. 1. Alternatively, horizontal motion may be induced by pulling using pulleys with cables as in FIG. 3.

There are a series of springs (12) attached to all frames to lift a portion of the weight/friction from the swing arms (6) and transfer it onto the stationary frame (2). Springs 8 also add to centering force and add resonance to the oscillatory motion.

Figure 2:
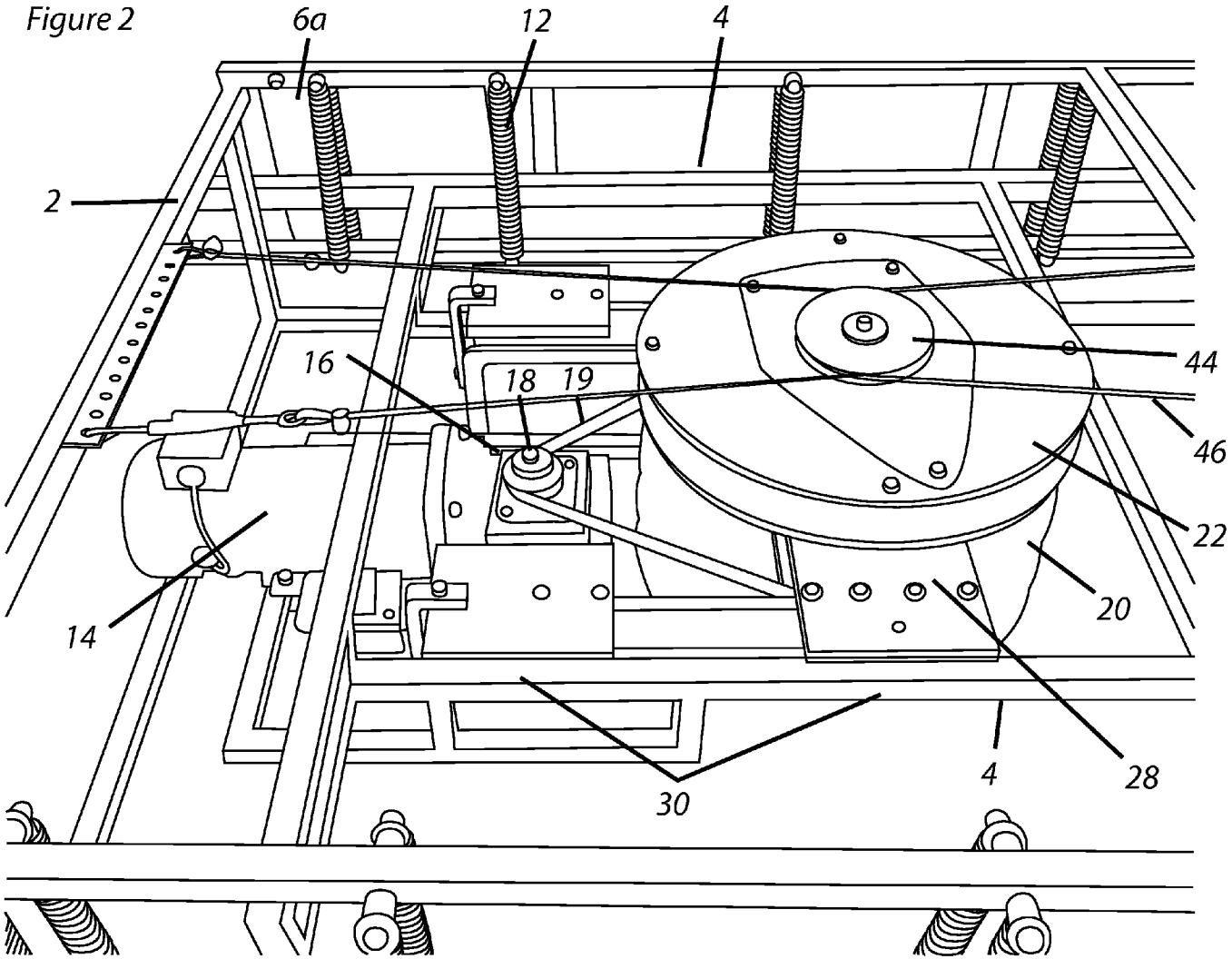
FIG. 2 is an oblique perspective view of the power transmission that applies the forces to give the bed motion.

As in FIG. 2, the power transmission (10) includes an electric motor (14) connected to a gearbox (16) with a small pulley (18) to ratio and reduce the speed. This alternate and preferred embodiment uses a belt 19 to drive the larger transmission pulley (20) which is connected to two actuator support wheels (22): one on top 22A, and one on the bottom 22B, with a shaft (24) and bearings (26) to attach it to a support frame (28). Each actuator support wheel (22) controls one direction of motion. The entire assembly is mounted to the center frame (4) with rubber mounts (30) to reduce vibration. The Pulleys 44 seem to wear out much more slowly than the rods (11) of FIG. 1.

Figure 3:
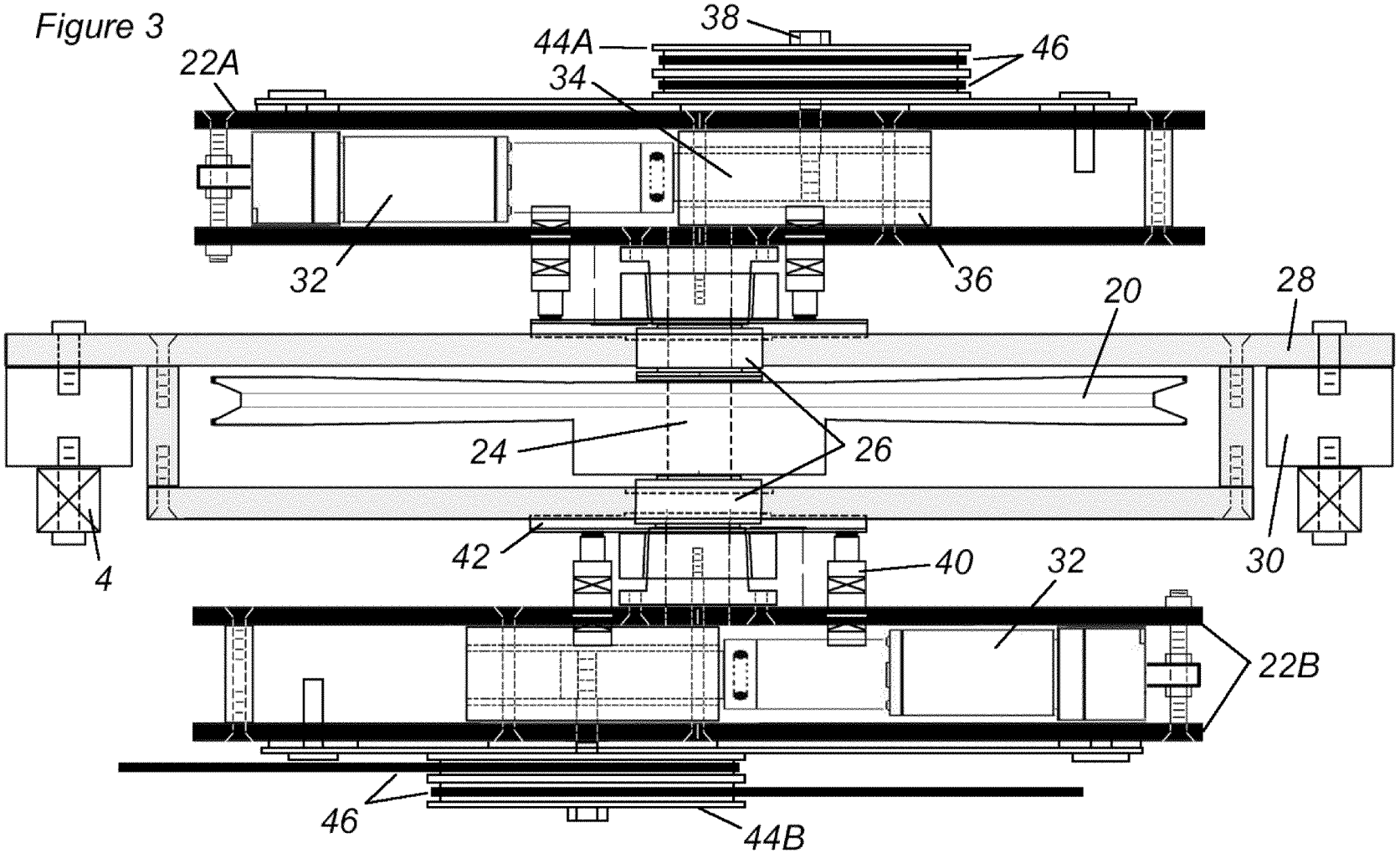
FIG. 3 is an elevation in section of the working mechanics of the power transmission.

As in FIG. 3, the two actuator support wheels (22) each have an electric actuator (32) mounted to a wheel at one end. An actuator piston (34) travels through a support block (36) also mounted to wheel (22). The support block (36) has an open slot in the top, which allows the pivot pin (38), which is attached to actuator piston (34), to travel, thus changing the stroke of the outer frame (8) or center frame 4 and thereby the bed, as in FIG. 1, when piston 34 is extended or retracted. The electricity for the rotating actuator (32) is received through a set of brushes (40) that rotate on a round copper contact plate (42). Each actuator support wheel (22) controls the actions of a side to side swing (pulley 44B) and a head to toe swing (pulley 44A).

Attached to the actuator pin (38) are five-inch cable pulleys (44) that pull against the stationary 2 and outer frames 8 with the cables (46) thus moving the center frame relative to the bed 1. The cable pulleys (44) allow the cable (46) length to remain taught and consistent. As the bed 1 goes into motion the strokes cause the distances between the frames 2, 4 & 8 to change. When both actuators (32) are retracted back to zero stroke the motor may run while the bed has no motion.

Figure 4:
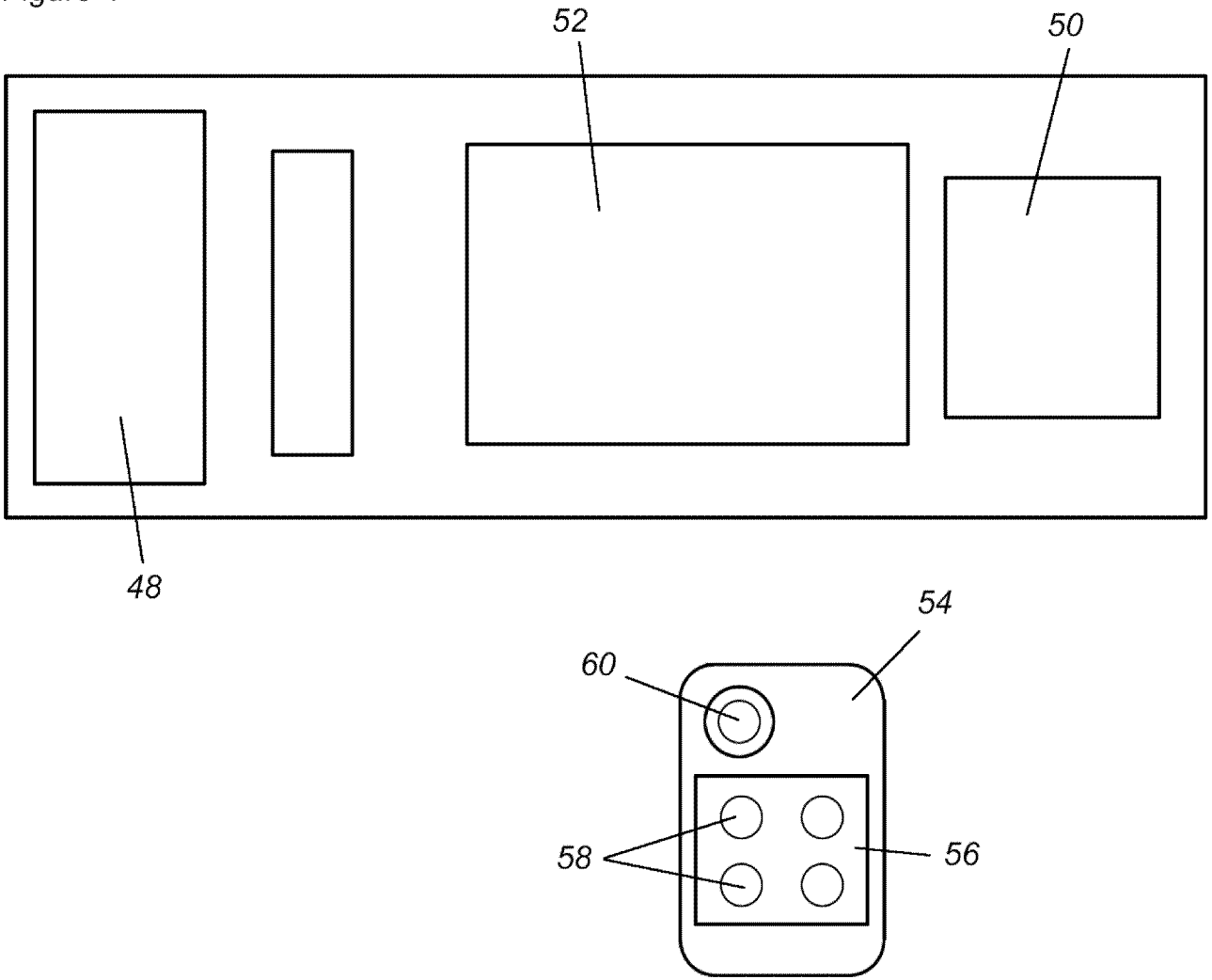
FIG. 4 is a block drawing of the electric control panel and hand control.

The electric control panel (FIG. 4) is 110 v with a 12 v power supply (48) for the actuators and the remote 4 channel RF receiver circuit (50). There is also a motor speed controller (52) to vary the speed of the bed. The bed is controlled with a hand held unit (54) that has a four channel transmitter circuit (56) with four buttons (58) to control the actuators along with a variable resistor (60) for controlling the speed.

Figure 5:
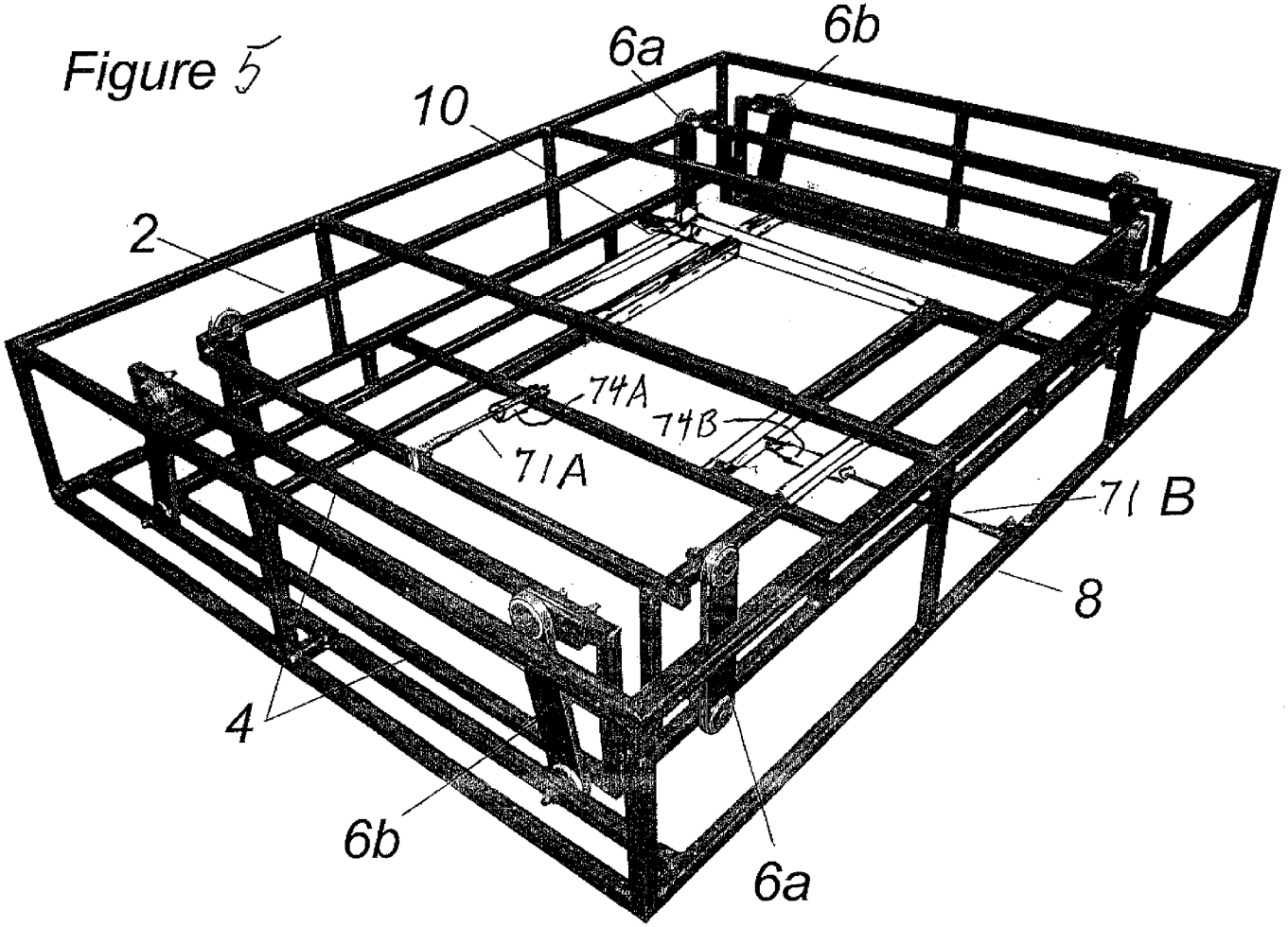
FIG. 5 is an oblique perspective view, similar to FIG. 1, showing the motion actuated by electric servos.

As in FIG. 5, the bed assembly 1 comprises a stationary frame (2), which sits on the floor and supports the entire bed assembly FIG. 1. Stationary frame (2) is the innermost of the three frames 2, 4, & 8.

The second or center frame (4) hangs from the stationary frame (2) by four swing arms (6*a*) with bearings. The second or center frame (4) hangs outside the stationary frame (2), centered between stationary frame (2) and the third or outer frame (8).

The third or outer frame (8), which supports the box spring and mattress (not shown), hangs from the center frame (4) also using four swing arms (6*b*) with bearings.

The center frame (4) mounts the actuators 74A & 74B which provide the motion of pulling and pushing using rod 71A from the stationary frame (2) and rod 71B to the outer frame (8) as in FIG. 5. Rod 71A is moved relative to the center frame 4 by electric servo 74A. Rod 71B is moved relative to the center frame 4 by electric servo 74*b*.

The presently preferred embodiment does not use the springs shown in FIG. 2.

Figure 6:
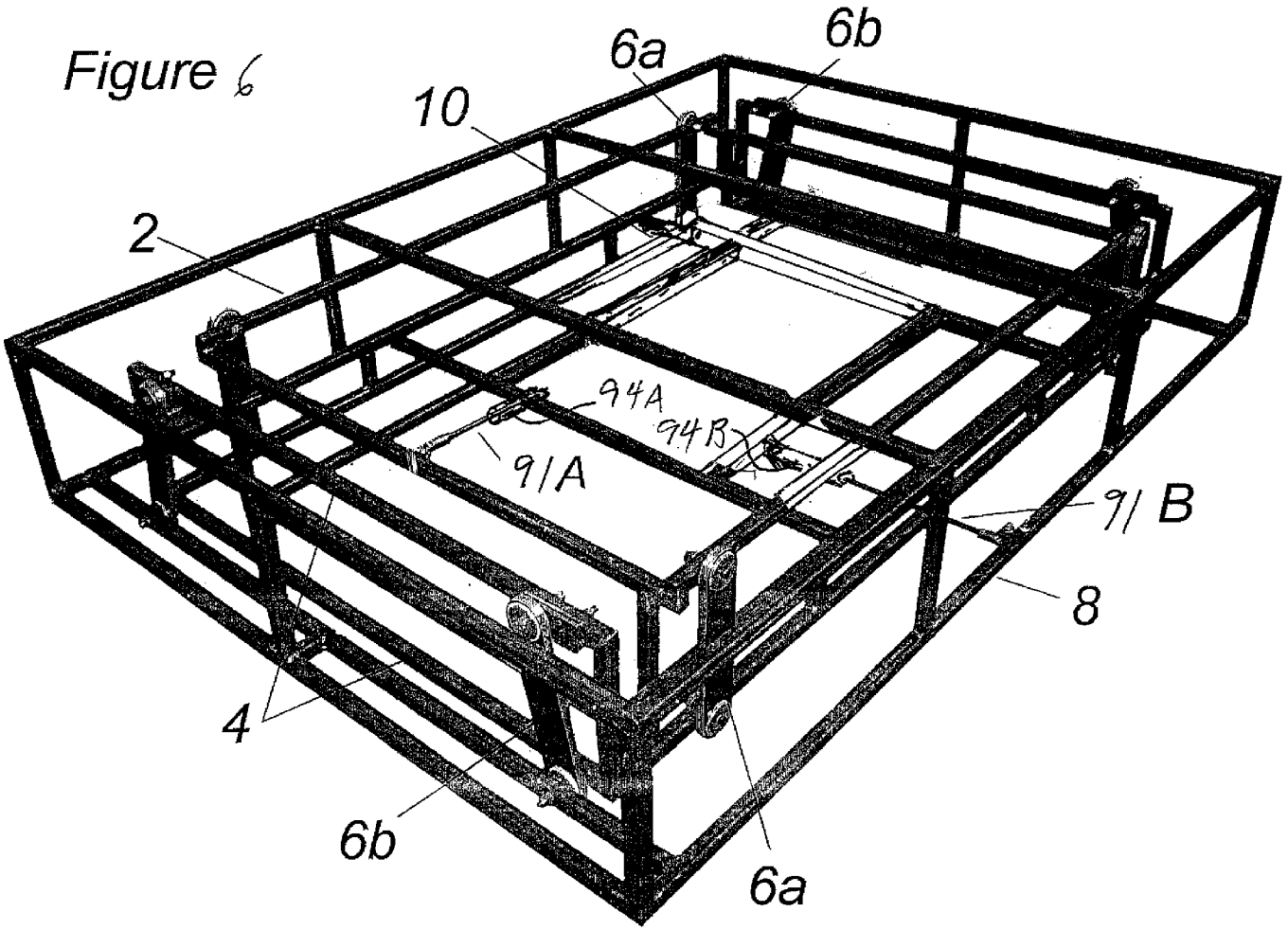
FIG. 6 is an oblique perspective view, similar to FIG. 1, showing the motion actuated by hydraulic cylinders.

As in FIG. 6, the bed assembly 1 comprises: a stationary frame (2), which sits on the floor and supports the entire bed assembly FIG. 1. Stationary frame (2) is the innermost of the three frames 2, 4, & 8.

The second or Center frame (4) hangs from the stationary frame (2) using four swing arms (6*a*) with bearings. The second or center frame (4) hangs outside the stationary frame (2), centered between stationary frame (2) and third or outer frame (8).

The third or outer frame (8), which supports the box spring and mattress, not shown, hangs from the center frame (4) also using four swing arms (6*b*) with bearings.

The center frame (4) mounts the actuators 94A & 94B which provide the motion of pulling and pushing using rod 91A from the stationary frame (2) and rod 91B to the outer frame (8) as in FIG. 5. Rod 91A is moved relative to the center frame 4 by hydraulic cylinder 94B. Rod 91B is moved relative to the center frame 4 by hydraulic cylinder 94B.

The presently preferred embodiment does not use the springs shown in FIG. 2.

Figure 7B:
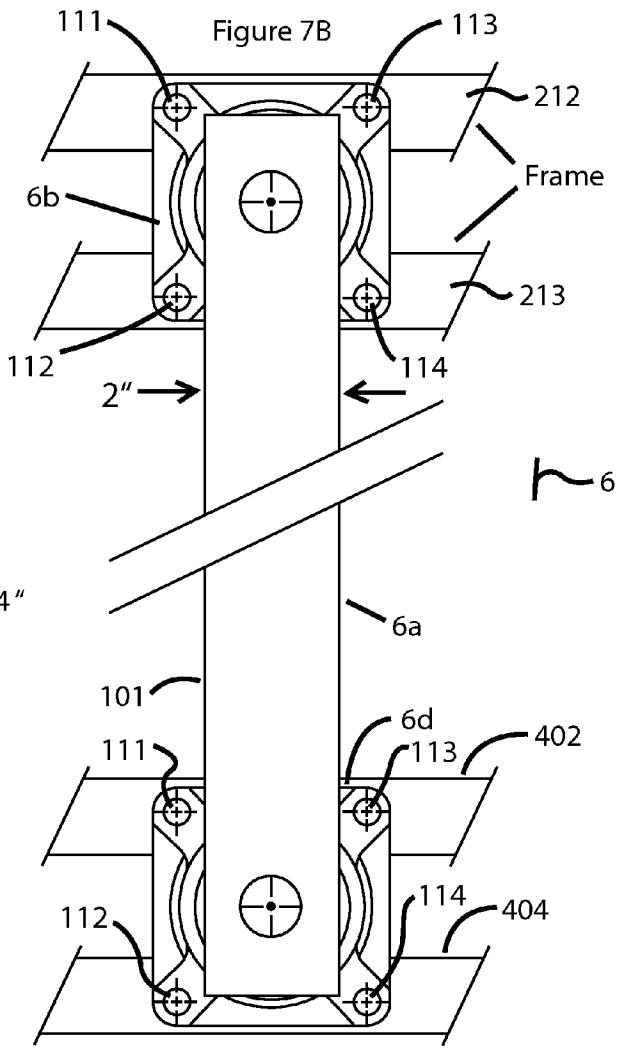
FIG. 7B is a front elevation thereof without nuts 6*e*.
Figure 7A:
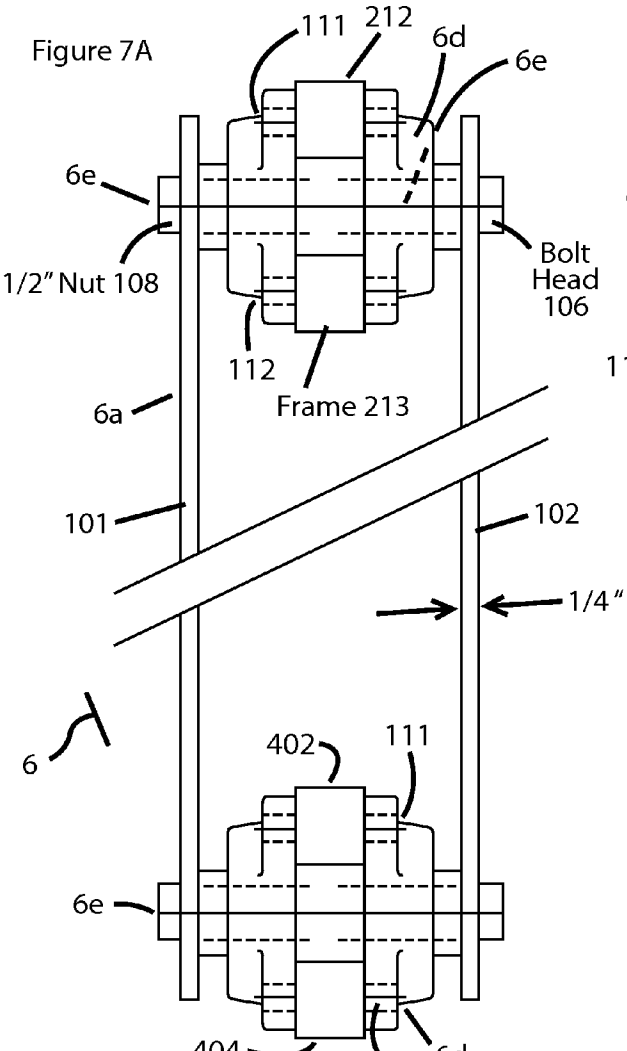
FIG. 7A is a side elevation of a swingarm 6*a*.
Figure 9A:
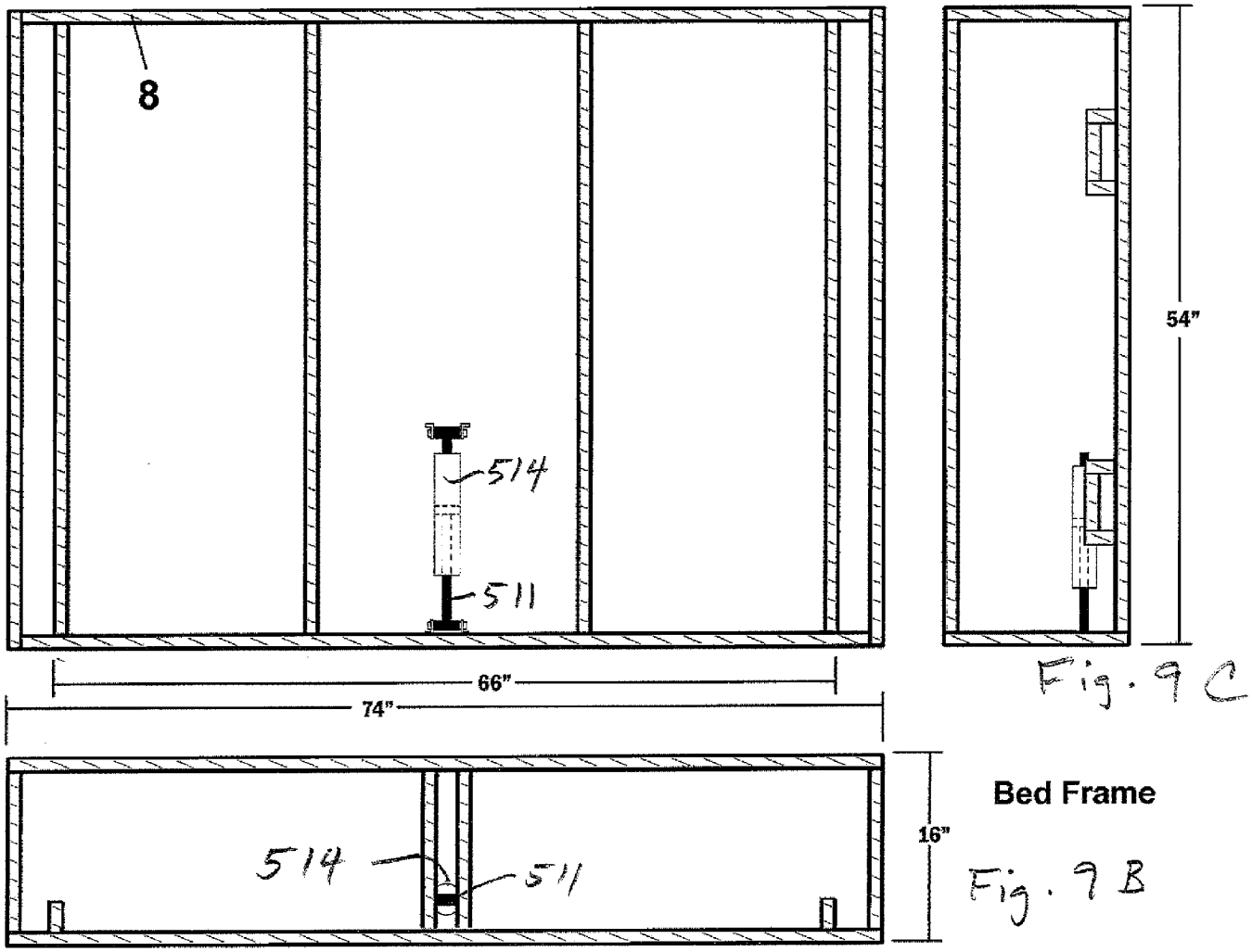
FIG. 9A is a plan view of outer frame, or bed frame, or third frame 8.

As in FIGS. 7A & 7B, the presently preferred swing arms 6, comprise:

a pair of solid steel bars 101-102, about two inches wide and a quarter inch thick.

A pair of bolts 6*e* pass through each bar 101-102 and mount, there-between, a commercially available flange bearing 6*d*. Bolt head 106 is shown against bar 102 in FIG. 7A. Nut 108 secures bolt 6*e* against bar 101.

FIG. 7B shows the swing arm assembly 6*a* without nut 108 yet in place. Bearing 6*d* is secured by bearing bolts 111-114 to frame rails 212-213 of inner frame 2. Similar bearing 6*d* is secured by bearing bolts 111-114 to frame rails 412-413 of center frame 2. See also FIG. 11B.

Figures 10A, 10B, 10C:
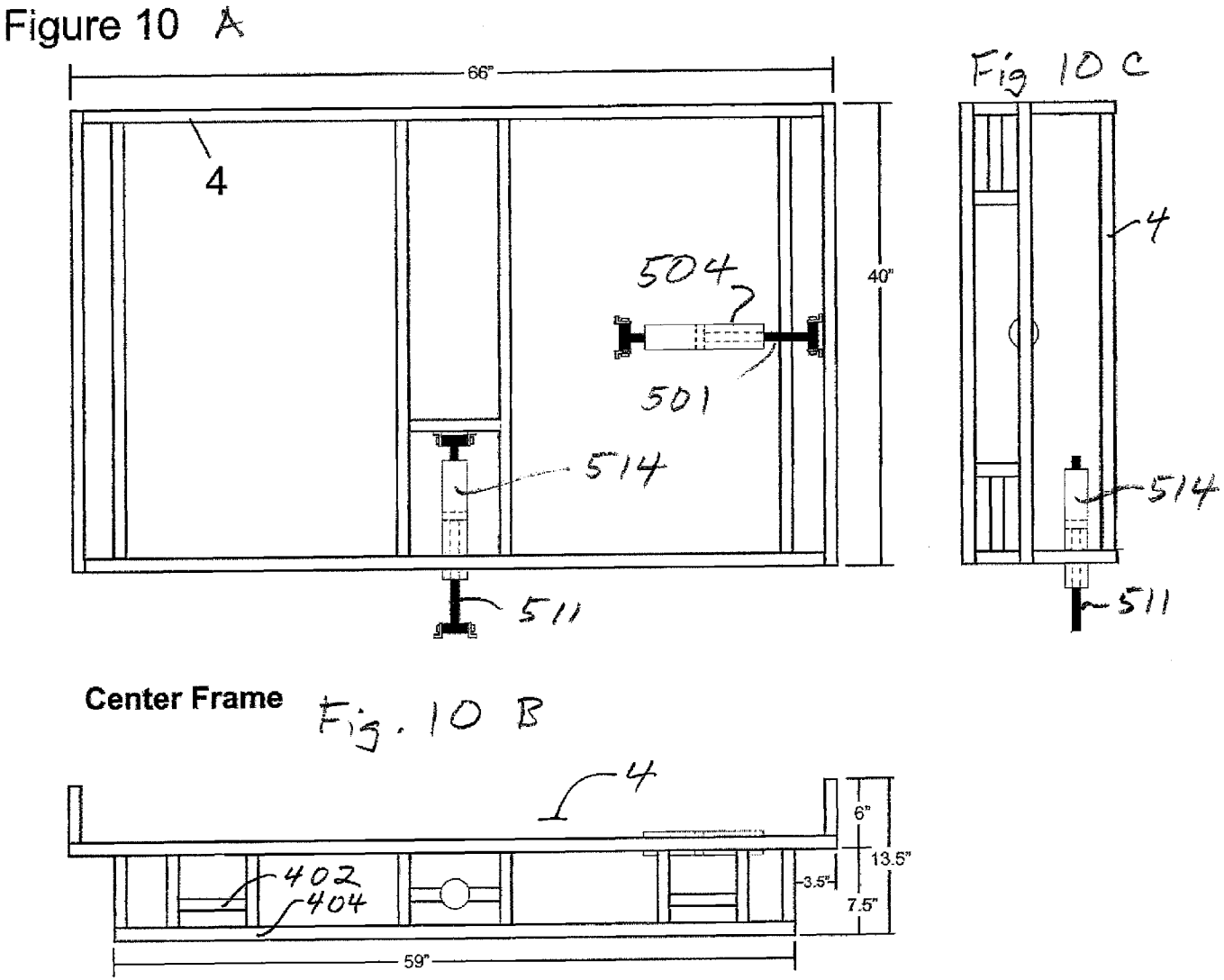
FIG. 10A is a plan view of center frame 4.
FIG. 10B is a side elevation thereof.
FIG. 10C is a foot-ward projection from FIG. 9A.

For further clarity, FIG. 8A shows a plan view of stationary frame 2. Linear actuator 504 can be either a hydraulic cylinder, a servo, or a linear induction device such as a solenoid, to pull and push rod 501. For a hydraulic cylinder such as 94 in FIG. 6, hydraulic lines would be attached to cylinder 94. For a servo, solenoid, or linear induction actuator, wires, not shown, supply direct current that reverses, to change the direction of horizontal motion, and thereby create the oscillating horizontal motion of the bed. Stationary frame 2 remains motionless with respect to the floor while actuator 504 moves rod 501 and the central frame 4 that rod 501 is attached to, in a head-ward and a toe-ward direction, FIG. 10A. As in FIG. 10 A. Rod 511 is actuated by linear actuator 514 to move outer frame or bedframe 8 in a side to side direction, as in FIG. 11*a*.

Figure 11C:
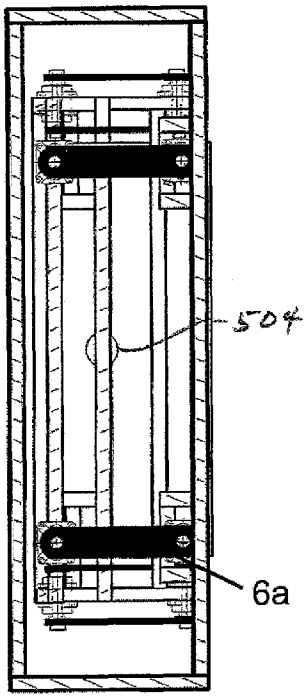
FIG. 11C is a foot-ward projection from FIG. 11A.
Figure 11A:
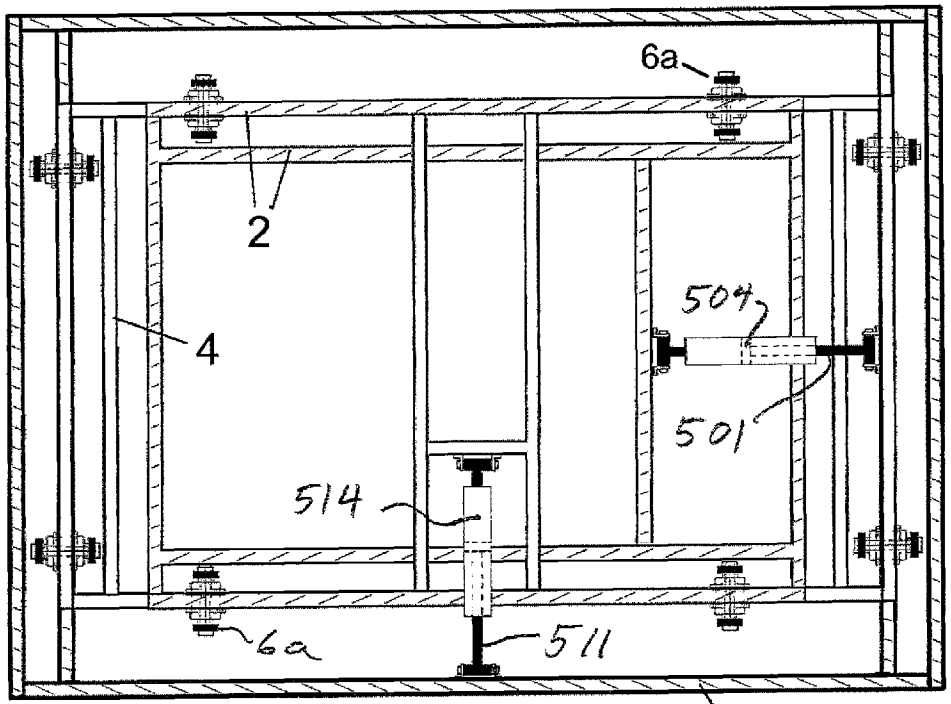
FIG. 11A is a plan view of the three frames 2, 4, and 8 assembled together.
Figure 11B:
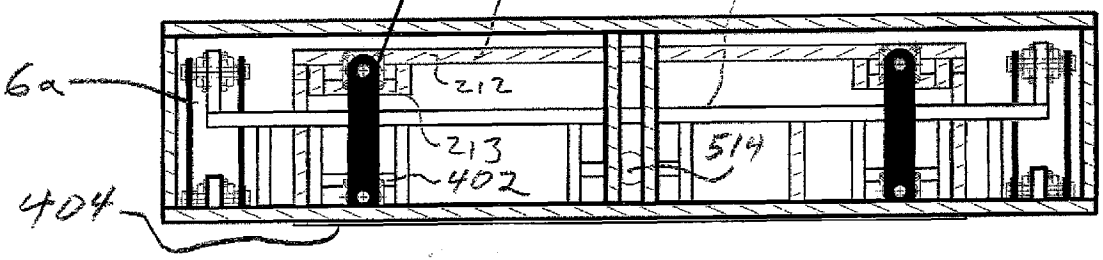
FIG. 11B is a side elevation thereof.

FIGS. 11A through 11C show three frames 2, 4, & 8 assembled together. To distinguish the three frames, the shading is different for each frame. Frame 2 has the shading lines sloping upward from left to right. Central frame 4 as no shade lines. Outer frame or bedframe 8 has the shade lines sloping downward from left to right.

I claim:

1. A bed assembly (1) comprises:

a stationary frame (2), which sits on the floor and supports the entire bed assembly;

a second frame (4), is configured to continuously oscillate in a first horizontal direction relative to the stationary frame, and is moveably supported by the stationary frame;

a third frame (8), which is configured to continuously oscillate in a second horizontal direction relative to the second frame, and is moveably supported by the second frame;

the second frame (4) hangs from the stationary frame (2) using four swing arms (6*a*);

the second frame hangs outside the stationary frame (2), between the stationary frame (2) and the third frame (8);

the four swing arms each describe an arc movement, and the second frame is gravity-biased to hang at the bottom of said arc;

the third frame hangs from the second frame using a second four swing arms (6*b*)

the second four swing arms each describe an arc movement, and the third frame is gravity-biased to hang at the bottom of said arc.

2. A bed assembly according to claim 1, in which:

a first powered actuator is configured to oscillate the second frame (4) in the first horizontal direction relative to the stationary frame;

a second powered actuator is configured to oscillate the third frame (8), in the second horizontal direction relative to the second frame;

said gravity bias of the second and third frames, at the bottoms of all said arcs, serve to facilitate oscillatory motion of said frames by assisting a return of said frames to the bottoms of said arcs; and all eight said arcs together add a vertical component to the oscillatory motion of said second and third frames.

3. A bed assembly according to claim 2, in which:

the third frame (8), supports a box spring and a mattress.

4. A bed assembly according to claim 1, in which:

a first powered actuator is configured to oscillate the second frame (4), in the first horizontal direction relative to the stationary frame; and a second powered actuator is configured to oscillate the third frame (8), in the second horizontal direction relative to the second frame;

the third frame (8), supports a box spring and mattress.

5. A bed assembly according to claim 4, in which:

the first and second powered actuators (71A & 71B) are electric servos (74A).

6. A bed assembly according to claim 2, in which:

the first and second powered actuators (71A & 71B) are electric servos (74A).

7. A bed assembly according to claim 2, in which:

the first and second powered actuators are hydraulic cylinders.

8. A bed assembly according to claim 4, in which:

the first and second powered actuators are hydraulic cylinders.

9. A motion bed according to claim 4 having:

a hand held unit (54);

said hand held unit has:

a four channel transmitter circuit (56);

four buttons (58) to control the actuators; and a variable resistor (60) for controlling the first and second powered actuators' speed.

10. A bed assembly (1) comprises:

a stationary frame (2), which sits on the floor and supports the entire bed assembly;

a second frame (4), is configured to oscillate in a first horizontal direction relative to the stationary frame, and is moveably supported by the stationary frame;

a third frame (8), which is configured to oscillate in a second horizontal direction, relative to the second frame, and is moveably supported by the second frame;

the second frame (4) hangs from the stationary frame (2) using four swing arms (6*a*), which swing in parallel to each other;

the third frame hangs from the second frame using a second four swing arms (6*b*), which swing in parallel to each other;

the second frame hangs outside the stationary frame (2), between the stationary frame (2) and the third frame (8);

the four swing arms each describe an arc, and the second frame is gravity-biased to hang at the bottom of said first four arcs;

the second four swing arms each describe an arc, and the third frame is gravity-biased to hang at the bottom of said second four arcs;

said gravity bias of the second and third frames, at the bottoms of all said arcs, is configured to facilitate oscillatory motion of said second and third frames, by assisting a periodic return of said frames to the bottoms of said arcs;

a first powered actuator is configured to oscillate the second frame (4), in the first horizontal direction relative to the stationary frame; and a second powered actuator is configured to oscillate the third frame (8), in the second horizontal direction relative to the second frame;

the first four arcs are configured to add a first vertical wave to the oscillatory motion of said second and third frames;

the second four arcs are configured to add a second vertical wave to the oscillatory motion of said third frame;

the third frame (8), supports a mattress.

11. A bed assembly according to claim 10, in which:

the first and second powered actuators are hydraulic cylinders.

12. A bed assembly according to claim 10, in which:

the first and second powered actuators (71A & 71B) are electric servos (74A).

13. A motion bed according to claim 12 having:

a hand held unit (54);

said hand held unit has:

a four channel transmitter circuit (56);

four buttons (58) to control the actuators; and a variable resistor (60) to control the first and second powered actuators' speed.

* * * * *